United States Patent [19]

Vultaggio et al.

[11] Patent Number: 4,974,266

[45] Date of Patent: Dec. 4, 1990

[54] SITE-ASSEMBLED SWIMMING POOL STRUCTURE

[76] Inventors: Mark D. Vultaggio; Richard Vultaggio, both of Box 51, McFadden Rd., Apalachin, N.Y. 13732

[21] Appl. No.: 356,068

[22] Filed: May 24, 1989

[51] Int. Cl.[5] ..... E04H 4/00

[52] U.S. Cl. ..... 4/506; 4/503

[58] Field of Search ..... 4/506, 498, 503, 496; 52/169.7, 300, 248

[56] References Cited

U.S. PATENT DOCUMENTS

| | | | |
|---|---|---|---|
| 1,882,942 | 10/1932 | Ross | 52/248 |
| 2,818,009 | 12/1957 | Steffen | 52/248 |
| 2,864,098 | 12/1958 | Lorimer | 4/506 |
| 3,233,251 | 2/1966 | Barrera | 4/506 |
| 3,648,303 | 3/1972 | Stewart et al. | 4/506 |
| 4,011,607 | 3/1977 | Davidoff | 4/503 |
| 4,158,244 | 6/1979 | Stefan | 4/506 |
| 4,182,087 | 1/1980 | Schall et al. | 4/506 |
| 4,290,241 | 9/1981 | Tucker | 4/513 |
| 4,429,425 | 2/1984 | Weir et al. | 4/506 |
| 4,457,119 | 7/1984 | Dahowski | 4/498 |
| 4,562,603 | 1/1986 | Paradis | 4/506 |
| 4,713,849 | 12/1987 | Kindness | 4/506 |
| 4,843,658 | 7/1989 | Hodak | 4/506 |
| 4,847,926 | 7/1989 | Laputka | 4/506 |

*Primary Examiner*—Henry J. Recla
*Assistant Examiner*—Keith Kupferschmid
*Attorney, Agent, or Firm*—Charles S. McGuire

[57] ABSTRACT

A swimming pool structure for on-site assembly including a flexible liner supported by a surrounding wall of side-by-side, wooden staves. One of the vertical edges of each stave is formed as a concave and the other as a convex surface. When the staves are arranged side-by-side, the convex surface of each stave nests within and contacts the concave surface of the adjoining stave. A plurality of cables pass entirely around the wall, and the cables are tensioned to urge the staves into tightly engaged relation. A downwardly-facing, U-shaped track member extends around the upper periphery of the wall and snugly engages the upper ends of the staves. The track member includes supplemental wall portions forming open channels for releasably receiving bead portions on the pool liner and a removable cover. A closed-cell, polyethylene sheet is preferably interposed between the vertical wall of the pool liner and the staves to provide a protective layer for the liner.

13 Claims, 1 Drawing Sheet

SITE-ASSEMBLED SWIMMING POOL STRUCTURE

BACKGROUND OF THE INVENTION

The present invention relates to swimming pool structures of the type comprising a pre-packaged collection of elements adapted for final assembly at the site where the pool is to be located. More specifically, the invention is directed to swimming pools for above or below ground installation of the type having a water-containing liner of flexible vinyl, or the like, with a surrounding support wall.

Swimming pool constructions of the foregoing type have been popular for many years as a relatively inexpensive alternative to in-ground pools which generally require more extensive excavation, either in-situ or off-site fabrication of a rigid, integrally formed structure to contain the pool water, and more elaborate connections of fill and drain lines, filters, etc. The flexible liners, of course, require a surrounding support structure which has typically taken the form of a plurality of rigid or semi-rigid panels assembled in a supporting framework in the same configuration, e.g., circular or oval, as the liner. The panels are usually several feet in length and width, and must be assembled with the supporting framework following initial and separate assembly of the latter. Thus, construction of such swimming pools requires the shipment, handling and assembly of a number of sizeable components.

It is a principal object of the present invention to provide a swimming pool structure including a flexible liner of waterproof material supported by a wall comprised of relatively small, lightweight, wooden elements which may be quickly and easily assembled at the site of the pool.

Another object is to provide a practical and economical swimming pool wherein a flexible liner is supported by a surrounding wall of wooden elements.

A further object is to provide a swimming pool construction having a wall of adjoining wooden elements with novel and improved means for affixing both a liner and a cover of flexible, waterproof material in operative engagement therewith.

Other objects will in part be obvious and will in part appear hereinafter.

SUMMARY OF THE INVENTION

In accordance with the foregoing objects the invention contemplates a swimming pool construction including a flexible, vinyl liner supported by a surrounding wall of adjacent, elongated wooden elements referred to herein as staves since the assemblage thereof is barrel-like in nature. The staves are of equal length, having planar inner, outer, top and bottom surfaces, and opposite sides respectively defined by mutually mating surfaces. In the disclosed and preferred embodiment, the sides are defined by convex and concave surfaces. The wall is assembled by placing the staves in a side-by-side relation with the convex sides of each stave nesting in and firmly engaging the concave sides of adjacent staves. The lower ends of the staves may be placed in an optional, bottom track member having a U-shaped cross section.

It is anticipated that the peripheral outline of the pool will have a curved configuration, e.g., circular or oval. The mutually mating side surfaces of the staves permits side-by-side assembly thereof in such configurations even though the inner and outer surfaces of the staves are flat. Also, the relatively narrow width of the individual staves provides a large degree of latitude in selection of the dimensions of the peripheral outline of the pool, i.e., depending upon the total number of staves used. After, or concurrently with, assembly of the staves in side-by-side relation, an upper track member is placed over the upper ends of the staves. A plurality of steel cables are then passed around the entire wall and tensioned to forcibly urge the staves into tight, mutual engagement.

The upper track member has a portion of U-shaped cross section facing downwardly, over the upper ends of the staves, and a first supplemental wall portion joined to and held in spaced, parallel relation with the medial section of the U-shaped portion by second and third supplemental wall portions. These wall portions of the upper track member form inwardly and outwardly facing, open channels extending about the entire periphery of the support wall. A lip extends upwardly from the lower side of the inwardly facing channel, and a second lip extends downwardly from the upper side of the outwardly facing channel, along the open side of each channel. The liner and a pool cover, also of flexible vinyl, or the like, each have a bead portion extending about their peripheries. The bead portion of the liner and that of the cover may be placed in the inwardly and outwardly facing channels, respectively, and retained against inadvertent withdrawal by the lips on the track member.

The foregoing and other features of construction and cooperative relationships of the elements of the invention will be more fully understood and appreciated from the following detailed description and accompanying drawing.

DETAILED DESCRIPTION

Figure 1:
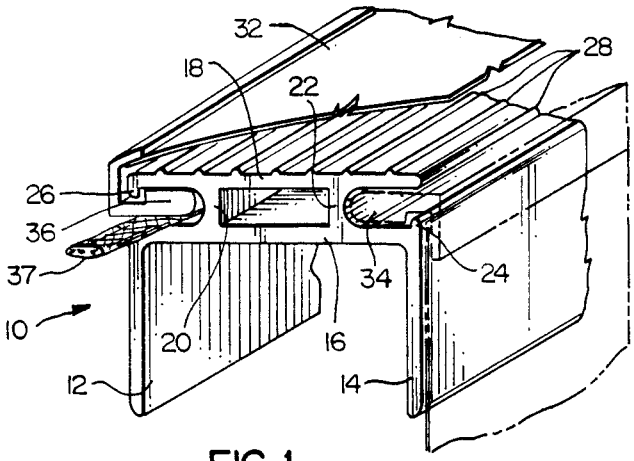
FIG. 1 is a fragmentary, perspective view of selected portions of the swimming pool structure of the invention.

Referring now to the drawing, in FIG. 1 is shown an element of the preferred embodiment of the pool structure termed an upper track member and designated generally by reference numeral 10. Track member 10 includes a portion generally U-shaped end view or cross section, including leg portions 12 and 14 extending from medial wall 16. Supplemental wall portion 18 of track member is joined to and held in spaced, parallel relation with medial wall 16 by supplemental wall portions 20 and 22, forming inwardly and outwardly facing, open channels on opposite sides of upper track member 10. Lip 24 extends upwardly from the lower side of the inwardly facing channel at the open side thereof. Lip 26 extends downwardly from the upper side of the outwardly facing channel at the open side thereof.

Raised ribs 28 are preferably formed, in the upper surface of wall portion 18. Track member 10 is preferably an extrusion formed from ultra-violet resistant plastic material.

Also seen in FIG. 1 are pool liner 30 (phantom lines) and cover 32, both of which are of flexible, waterproof material, such as 20 mil and 12 mil vinyl, respectively. Bead portions 34 and 36 are fixedly attached, as by heat fusing of thermoplastic materials, to liner 30 and cover 32,respectively, about the entire peripheries of each. Bead portions 34 and 36 are so configured that a shoulder on each is engaged behind lips 24 and 26 of the respective channels of track member 10 wherein the bead portions are positioned. The bead portions may be easily snapped into place manually, progressing around the entire peripheries of the liner and cover. Once bead portion 34 of liner 30 has been fully engaged, it will not be inadvertently disengaged by the normal downward pressures exerted upon the bead portion by the liner, due to the engagement of the shoulders on the bead portion with the corresponding lip on the track member channel. After engaging bead portion 36 of cover 32 into the outwardly facing channel around the entire periphery, a supplementary locking device 37, such as nylon coated clothesline cord, is inserted into the channel, utilizing a device commonly available and referred to as a screen roller or repair tool. The purpose of this locking device is to prohibit the inadvertant disengagement of pool cover 32 by forcing positive engagement of cover bead 36 and lip 26. However, the bead portion of the cover may be easily manually disengaged by removing the locking cord 37 and any water or debris caught on top of the cover, and lifting the bead portion of the cover in a downward and outward motion from the channel.

Figure 5:
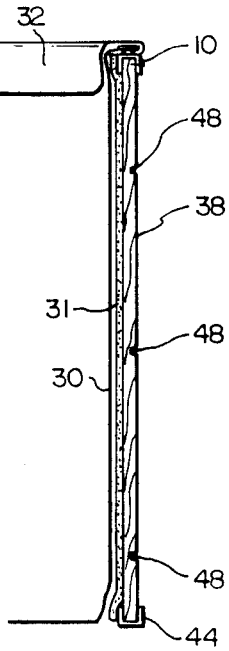
FIG. 5 is an elevational view in section on the line 5—5 of FIG. 4.

When cover 32 is attached to the support wall in the indicated manner, it is preferred that the horizontal portion thereof be positioned a few inches below the plane of the upper edge of the pool, i.e., approximately at the normal water level, as shown in FIG. 5. A further element preferably included in the structure, as also seen in FIG. 5, is layer 31, interposed between liner 30 and the inner sides of staves 38. Layer 31 is a flexible sheet of closed cell, polyethylene foam, on the order of $\frac{1}{8}''$ to $\frac{1}{4}''$ thick, extending about the entire periphery of the pool to protect liner 30 against punctures from splinters or other surface irregularities in staves 38.

Figure 2:
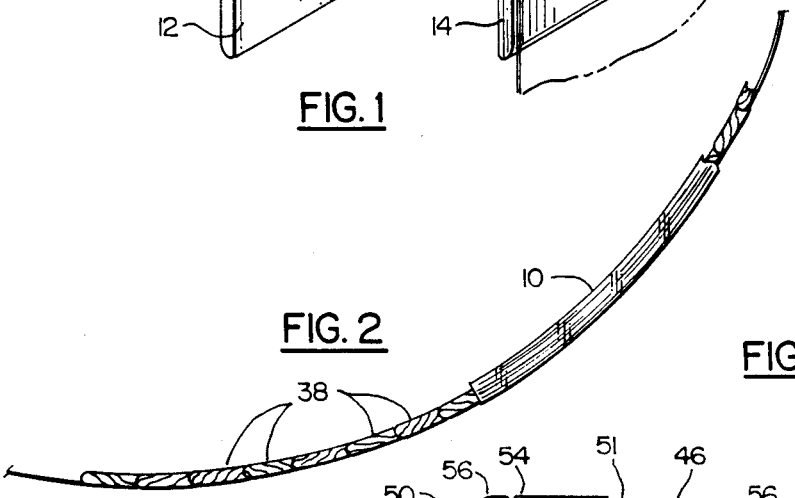
FIG. 2 is a fragmentary, plan view of the structure.
Figure 3:
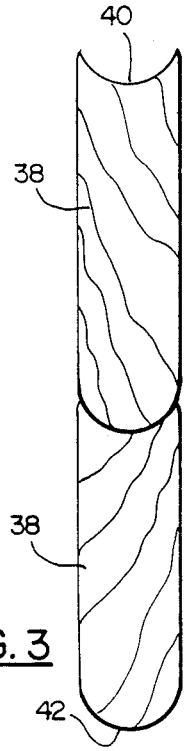
FIG. 3 is a plan view of two adjacent members which form the support wall of the pool structure.
Figure 6:
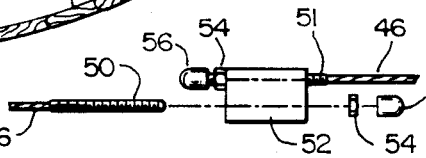
FIG. 6 is a fragmentary, perspective view of other elements of the pool structure.
Figure 4:
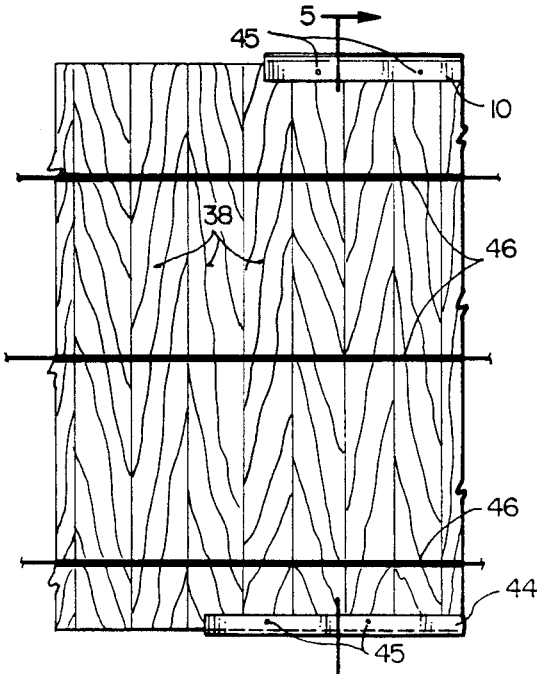
FIG. 4 is a fragmentary, elevational view of the pool structure.

The support wall for liner 30, forming an important part of the invention, is provided by a continuous succession of wooden staves 38, seen in FIGS. 2–5, to which reference is now made. Staves 38 are essentially identical in all respects, having planar inner, outer, upper and lower surfaces and opposite sides defining mutually mating surfaces. That is, the side surfaces are so configured that each side of all staves has portions which fit in mating engagement with the opposite side of another stave. In the illustrated embodiment, the mutually mating surfaces of staves 38 are defined by concave and convex surfaces 40 and 42, respectively, as seen in FIGS. 2 and 3. Staves 38 are arranged vertically, in side-by-side relation with convex surface 42 of each stave nesting in and contacting the concave surface 40 of the adjoining staves. In the illustrated embodiment, the lower ends of staves 38 are firmly engaged between the leg portions of upwardly-facing, lower track member 44, which may be omitted, if desired. In any case, the upper ends of staves 38 are engaged between leg portions 12 and 14 of upper track member 10. Either or both of upper and lower track members 10 and 44 may be secured in a more permanent manner to staves 38, if desired, by fastening means such as the illustrated screws 45.

The curvature of surfaces 40 and 42 permits placement of adjacent staves 38 in either linear or non-linear lateral relationship, whereby the peripheral outline of the support wall formed by the continuous succession of staves may assume a circular or oval configuration. The wall is formed in the desired peripheral outline and dimensions, conforming to the outline and dimensions of liner 30 and cover 32, by arranging the necessary number of staves 38 in the required configuration. Staves 38 may be of any desired dimensions, preferably having a thickness and width on the order of nominal $2''\times4''$, $2''\times6''$ or $2''\times8''$ boards. The concave and convex side surfaces may be formed by conventional milling techniques which further reduces the effective width of the boards.

After staves 38 are arranged in the desired peripheral outline or shape, with their upper and lower ends engaged in upper and lower track members 10 and 44, each of which extends substantially continuously about the peripheral configuration of the support wall, construction of the support wall is completed by passing a plurality of flexible cables 46 entirely around the wall. Grooves 48 (FIG. 5) are preferably provided at spaced intervals in the outer surface of each of staves 38, as seen in FIG. 5, to receive cables 46. Threaded, stainless steel studs 50 and 51 are hydraulically swaged to opposite end portions of cables 46. End portions 50 and 51 are passed through openings in block 52 and secured by nuts 54 which are tightened with a wrench to apply tension to cables 46, thereby compressionally engaging staves 38 and urging adjacent staves into tight mutual engagement. Cables 46 are preferably vinyl or nylon coated, galvanized steel cable. Protective end caps 56 are preferably inserted on the cable ends projecting through nuts 54.

Upon completion of the support wall, liner 30 is attached thereto as previously explained, and may be filled with water. The support wall may be constructed entirely above ground, or within an appropriate excavation which is back-filled around the wall after completion of pool construction for in-ground pools. In either case it is preferred that staves 38 be appropriately pressure treated for resistance to the effects of moisture, soil, insects etc., or constructed of redwood or other wood which is longer lasting in its natural state.

What is claimed is:

1. A site-assembled swimming pool structure comprising, in combination:

(a) a liner of flexible, waterproof material having a continuous, vertically disposed side wall of predetermined peripheral outline, an open top and a continuous, horizontally disposed bottom wall;

(b) a vertically disposed support wall formed by a continuous succession of elongated wooden staves of equal length and thickness, each having opposite sides respectively defining first and second surfaces configured for mutually mating relationship, and upper and lower planar ends;

(c) said staves being arranged in vertically elongated, side-by-side relation with said first surface side of each stave being mated with and contacting said second surface side of the adjacent stave, said succession of staves being arranged in said predetermined outline with said lower ends resting on an underlying support;

(d) an upper track member of downwardly facing, U-shaped cross section having two leg portions spaced by a distance substantially equal to said thickness of said staves and a medial portion extending between and joining said leg portions, said upper track member extending substantially continuously about said support wall in said predetermined outline with portions of said staves, including and adjacent said upper ends thereof, positioned and frictionally engaged between said leg portions of said upper track member, said frictional engagement being sufficient to provide the sole support for said staves in said vertically elongated, side-by-side relation;

(e) a plurality of flexible cables extending completely around said support wall and contacting said outer sides of each of said staves at vertically spaced positions intermediate of said upper and lower ends thereof;

(f) means for applying tension to said cable, thereby forcibly urging said staves into tight engagement with the adjacent staves about said predetermined peripheral outline; and (g) means for releasably attaching said liner continuously about said open top thereof to said support wall adjacent said upper ends of said staves.

2. The invention according to claim 1 wherein at least a portion of said predetermined outline is curved.

3. The invention according to claim 2 wherein said first and second surfaces of said staves are convex and concave, respectively, in plan view along their entire lengths, and of substantially equal radii, whereby said convex surface of each of said staves is fully nested in said concave surface of the adjacent stave.

4. The invention according to claim 2 wherein said attaching means comprises a first bead portion affixed to and extending continuously around said open top of said liner and an inner engagement portion of said upper track member wherein said first bead portion is engaged entirely about said liner open top.

5. The invention according to claim 4 wherein said upper track member includes a first supplemental wall portion extending in substantially parallel, spaced relation to said medial portion, a second supplemental wall portion extending between and connecting said medial portion and said first supplemental wall portion, thereby forming a first channel between said medial portion and said first supplemental wall portion having an open side facing the inside of said predetermined outline, and a first lip extending upwardly from said medial portion toward said first supplemental wall portion and continuously about said upper track member at said open side of said first channel, said first bead portion being configured for insertion in said first channel and engagement by said first lip to releasably retain said first bead portion in said first channel.

6. The invention according to claim 5 and further comprising a cover of flexible, waterproof material having a periphery of said predetermined outline for placement over said open top of said liner to form a removable closure, and means for releasably securing said cover in fixed engagement with said support wall adjacent said upper ends of said staves.

7. The invention according to claim 6 wherein said securing means comprises a second bead portion affixed to and extending continuously around said cover periphery and an outer engagement portion of said upper track member wherein said second bead portion is engaged entirely about said cover periphery.

8. A site-assembled swimming pool structure comprising, in combination:

(a) a liner of flexible, waterproof material having a continuous, vertically disposed side wall of predetermined peripheral outline, an open top and a continuous, horizontally disposed bottom wall;

(b) a vertically disposed support wall formed by a continuous succession of wooden staves of equal length and thickness, each having opposite sides respectively defining first and second surfaces configured for mutually mating relationship, and upper and lower planar ends;

(c) said staves being arranged in side-by-side relation with said first surface side of each stave being mated with contacting said second surface side of the adjacent stave, said succession of staves being arranged in said predetermined outline;

(d) means for releasably attaching said liner continuously about said open top thereof to said support wall adjacent said upper ends of said staves, said attaching means comprising a first bead portion affixed to and extending continuously around said open top of said liner and an inner engagement portion of said upper track member wherein said first bead portion is engaged entirely about said liner open top;

(e) a cover of flexible, waterproof material having a periphery of said predetermined outline for placement over said open top of said liner to form a removable closure;

(f) means for releasably securing said cover in fixed engagement with said support wall adjacent said upper ends of said staves, said securing means comprising a second bead portion affixed to and extending continuously around said cover periphery and an outer engagement portion of said upper track member wherein said second bead portion may be engaged entirely about said cover peripheral;

(g) a plurality of flexible cables extending completely around said support wall and contacting said outer sides of each of said staves at vertically spaced positions intermediate in said upper and lower ends thereof;

(h) means for applying tension to said cable, thereby forcibly urging said staves into tight engagement with the adjacent staves about said predetermined peripheral outline; and (i) an upper track member of downwardly facing, U-shaped cross section having:

(i) two leg portions;

(ii) a medial portion joining said two leg portions;

(iii) a first supplemental wall portion extending in substantially parallel, spaced relation to said medial portion;

(iv) a second supplemental wall portion extending between and connecting said medial portion and said first supplemental wall portion, thereby forming a first channel between said medial portion and said first supplemental wall portion having an open side facing the inside of said predetermined outline;

(v) a first lip extending upwardly from said medial portion toward said first supplemental wall portion and continuously about said upper track member at said open side of said first channel, said first bead portion being configured for insertion in said first channel and engagement by said first lip to releasably retain said first bead portion in said first channel;

(vi) a third supplemental wall portion in spaced, parallel relation to said second supplemental wall portion extending between and connecting said medial portion and said first supplemental wall portion thereby forming a second channel between said metal portion and said first supplemental wall portion having an open side facing the outside of said predetermined outline, and (vii) a second lip extending downwardly from said supplemental wall portion toward said medial portion and continuously about said upper track member at said open side of said second channel, said second bead portion being configured for insertion in said second channel and engagement by said second lip to releasably retain said second bead portion in said second channel.

9. The invention according to claim 8 wherein said cables each include threaded opposite end portions and said means for applying tension comprise a block for each of said cables having a pair of openings through which said opposite end portions extend, and a nut on each of said threaded end portions abutting said block.

10. The invention according to claim 9 and further including a plurality of grooves formed in said outer surface of each of said staves and extending laterally thereacross at said spaced positions to provide a plurality of continuous grooves extending completely around said support wall, each of said cables being positioned in one of said continuous grooves.

11. The invention according to claim 10 and further including a lower track member of upwardly facing, U-shaped cross section having two leg portions and a medial portion, said lower track member extending substantially continuously about said support wall with the portions of said staves including and adjacent said lower ends thereof extending into and being snuggly engaged between said leg portions of said lower track member.

12. The invention according to claim 10 and further including a protective layer of material interposed between said vertically disposed side wall of said liner and said support wall.

13. The invention according to claim 12 wherein said protective layer is a sheet of closed-cell, polyethylene material extending from top to bottom and completely around said peripheral outline.

* * * * *